US007863531B2

(12) United States Patent
May et al.

(10) Patent No.: US 7,863,531 B2
(45) Date of Patent: Jan. 4, 2011

(54) TECHNIQUES FOR MAKING HIGH VOLTAGE CONNECTIONS

(75) Inventors: Douglas E. May, Melrose, MA (US); Kasegn D. Tekletsadik, Rexford, NY (US); Eric Hermanson, Georgetown, MA (US); Piotr R. Lubicki, Peabody, MA (US); Russell J. Low, Rowley, MA (US); Joseph C. Olson, Beverly, MA (US); Stephen E. Krause, Ipswich, MA (US)

(73) Assignee: Varian Semiconductor Equipment Associates, Inc., Gloucester, MA (US)

( * ) Notice: Subject to any disclaimer, the term of this patent is extended or adjusted under 35 U.S.C. 154(b) by 627 days.

(21) Appl. No.: 11/861,796

(22) Filed: Sep. 26, 2007

(65) Prior Publication Data

US 2009/0078554 A1 Mar. 26, 2009

(51) Int. Cl.
*H01H 9/00* (2006.01)

(52) U.S. Cl. ..... 200/61.13; 200/277; 200/503; 200/19.18

(58) Field of Classification Search ..... 200/503, 200/511, 543, 82 R, 82 B, 506, 547, 19.18, 200/241, 243, 252, 257, 273, 274, 277, 61.13
See application file for complete search history.

(56) References Cited

U.S. PATENT DOCUMENTS 6,717,079 B2 4/2004 Heller

*Primary Examiner*—Felix O Figueroa

(57) ABSTRACT

Techniques for making high voltage connections are disclosed. In one particular exemplary embodiment, the techniques may be realized as an electrical switch. The electrical switch may comprise a component extending from a first electrical contact to a second electrical contact. The component may also comprise a non-conductive section and a conductive section. In a first mode of operation, at least a portion of the non-conductive section may be positioned between the two electrical contacts to insulate the two electrical contacts. In a second mode of operation, the conductive section may be positioned between the two electrical contacts to connect the two electrical contacts.

8 Claims, 8 Drawing Sheets

TECHNIQUES FOR MAKING HIGH VOLTAGE CONNECTIONS

FIELD OF THE DISCLOSURE

The present disclosure relates generally to semiconductor manufacturing and, more particularly, to techniques for making high voltage connections.

BACKGROUND OF THE DISCLOSURE

Ion implantation is a process of depositing chemical species into a substrate by direct bombardment of the substrate with energized ions. In semiconductor manufacturing, ion implanters are used primarily for doping processes that alter the type and level of conductivity of target materials. A precise doping profile in an integrated circuit (IC) substrate and its thin-film structure is often crucial for proper IC performance. To achieve a desired doping profile, one or more ion species may be implanted in different doses and at different energy levels.

To form devices on a semiconductor wafer, it is usually necessary to implant impurities at different depths of the semiconductor wafer. The energy of impurities in an ion beam directed toward the semiconductor wafer is determinative of the depth to which the impurities penetrate into the semiconductor wafer. As devices are reduced in size and increased in speed, it has become desirable to use very low energy ion beams to form, for example, shallow transistor junctions in the semiconductor wafer.

At the same time, high energy ion implantation may help minimize production costs because high energy ion implantation does not require some conventional processes, such as, but not limited to, the masking of a semiconductor wafer, to be performed. Also, semiconductor devices manufactured through the use of high energy ion implantation may exhibit relatively low levels of junction leakage and improved latch-up characteristics. Thus, the production yield may be high with respect to an ion implantation process carried out by high energy ion implantation. Therefore, high energy ion implantation may be widely used for implanting ions in semiconductor device manufacturing processes.

FIG. 1 depicts a prior art ion implanter system 100. The ion implanter system 100 may comprise an ion source 102 and a complex series of components through which an ion beam 10 passes. The series of components may include, for example, an extraction manipulator 104, a filter magnet 106, an acceleration or deceleration column 108, an analyzer magnet 110, a rotating mass slit 112, a scanner 114, and a corrector magnet 116. The ion source 102, the extraction manipulator 104, and the filter magnet 106 may be housed in a terminal 118. Much like a series of optical lenses that manipulate a light beam, the ion implanter components can filter and focus the ion beam 10 before steering it towards an end station 120.

The terminal 118 is a critical component to the ion implanter system 100. In certain instances, an acceleration voltage for ion beams may be above 600 kV. As a result, during an ion beam acceleration mode, certain components of the ion implantation system 100, including, for example, the terminal 118, may be at a high voltage, while other components may be at a low voltage or ground. In other modes of operation, such as a deceleration mode, it may be necessary to connect a deceleration power supply to the ion source 102. Selectively providing an electrical connection to ground can be challenging, as the terminal 118 and other components may be physically separated from ground. Further, conductive material (e.g. a metal wire or switch) between the terminal 118 and ground may cause arcing when the system 100 is operated in a high voltage acceleration mode. Moreover, if there are components between the terminal 118 and ground (e.g., a ceramic insulator), there may be a concern for tracking distance. In the present disclosure, tracking distance may be referred to as the distance from one voltage potential to another voltage potential along a surface path of a component between two voltage potentials. A design rule may be followed to limit the tracking distance (e.g., 10 kV/inch in air).

In view of the foregoing, it may be understood that there are significant problems and shortcomings associated with current technologies in making high voltage connections for ion implanters.

SUMMARY OF THE DISCLOSURE

Techniques for making high voltage connections are disclosed. In one particular exemplary embodiment, the techniques may be realized as an electrical switch. The electrical switch may comprise a component extending from a first electrical contact to a second electrical contact. The component may also comprise a non-conductive section and a conductive section. In a first mode of operation, at least a portion of the non-conductive section may be positioned between the two electrical contacts to insulate the two electrical contacts. In a second mode of operation, the conductive section may be positioned between the two electrical contacts to connect the two electrical contacts.

In accordance with other aspects of this particular exemplary embodiment, the component may be a cable forming a loop around a first pulley positioned proximate the first electrical contact and a second pulley positioned proximate the second electrical contact. At least one pulley may be driven by a motor.

In accordance with further aspects of this particular exemplary embodiment, the electrical switch may also comprise a first housing constructed substantially of a non-conductive material between the two electrical contacts with at least a section of the component being in the first housing. The electrical switch may further comprise a shuttle attached to the component inside the first housing. The shuttle may be selectively displaceable within the first housing between a first position in the first mode of operation and a second position in the second mode of operation. The electrical switch may further comprise two openings in the first housing sized and shaped to connect with a source of a pressurized fluid. The shuttle may be a piston displaced between the first and second positions by the pressurized fluid. The pressurized fluid may be pressurized air. Alternatively, the electrical switch may comprise a second housing constructed substantially of a non-conductive material between the two electrical contacts with at least a section of the cable in the second housing. The cable may engage each distal end of the first and second housings in a fluid tight seal respectively. The piston may be displaced between the first and second position by pressurized high dielectric strength fluid selected from a group comprising: SF6 gas, and liquid silicone. Further, each of the first or second housings may have undulations on a surface respectively.

In accordance with additional aspects of this particular exemplary embodiment, the component may be a cable having a first distal end wound on a first spool proximate to the first electrical contact and a second distal end wound on a second spool proximate to the second electrical contact. Each of the first and second spools may be adapted to be driven by a motor respectively. The electrical switch may further comprise a housing between the first electrical contact and the second electrical contact with at least a section of the cable inside the housing. The cable may engage the housing at two distal ends of the housing via a fluid tight sealed cap respectively. The housing may be filled with a high dielectric strength material selected from a group comprising: SF6 gas, and silicone liquid.

In accordance with still other aspects of this particular exemplary embodiment, the non-conductive section may be a cable wound on a first spool and the conductive section may be a spring adapted to be stretched by winding the cable on the first spool.

In accordance with still further aspects of this particular exemplary embodiment, the electrical switch may further comprise a housing enclosing the first and second electrical contacts and the component. The first and second electrical contacts may be adapted to connect to outside electrical contacts via fluid tight feedthrus.

In another particular exemplary embodiment, the techniques may be realized as an electrical switch. The electrical switch may comprise a first electrical contact, a second electrical contact, a retractable conductor and a retractable conductive element. The retractable conductive element may be attached to the retractable conductor. The retractable conductive element may be connected to the second electrical contact and adapted to selectively displace the retractable conductor between a first position in a first mode of operation to connect the retractable conductor with the first electrical contact, and a second position in a second mode of operation to disconnect the retractable conductor from the first electrical contact.

In accordance with other aspects of this particular exemplary embodiment, the retractable conductive element may be a cable attached to the retractable conductor at a first distal end and wound around a spool at a second distal end. The spool may be adapted to be driven by a motor.

In accordance with further aspects of this particular exemplary embodiment, the retractable conductive element may be a spiral spring attached to the retractable conductor at a first distal end and wound around a spool at a second distal end. The spring may be adapted to be driven by a motor In accordance with additional aspects of this particular exemplary embodiment, the retractable conductive element may be a telescoping rod. The telescoping rod may be attached to the retractable conductor at a first distal end and connected to the second electrical contact at a base. The telescoping rod may be adapted to be driven by a mechanism selected from a group consisting of: a motor and pneumatic fluid.

In accordance with still other aspects of this particular exemplary embodiment, the retractable conductor may have a curved, flexibly attached wiping contact.

In accordance with still further aspects of this particular exemplary embodiment, the retractable conductor may comprise a socket suitable for receiving a wiping spring element to facilitate making electrical connection in the first mode of operation.

In accordance with still additional aspects of this particular exemplary embodiment, the first electrical contact may comprise a socket suitable for receiving a wiping spring element to facilitate making electrical connection in the first mode of operation.

In accordance with yet other aspects of this particular exemplary embodiment, the retractable conductor may have a smooth surface and the first electrical contact may comprise a receptacle. The receptacle may comprise a socket and a flexible wiping contact.

The present disclosure will now be described in more detail with reference to exemplary embodiments thereof as shown in the accompanying drawings. While the present disclosure is described below with reference to exemplary embodiments, it should be understood that the present disclosure is not limited thereto. Those of ordinary skill in the art having access to the teachings herein will recognize additional implementations, modifications, and embodiments, as well as other fields of use, which are within the scope of the present disclosure as described herein, and with respect to which the present disclosure may be of significant utility.

BRIEF DESCRIPTION OF THE DRAWINGS

In order to facilitate a fuller understanding of the present disclosure, reference is now made to the accompanying drawings, in which like elements are referenced with like numerals. These drawings should not be construed as limiting the present disclosure, but are intended to be exemplary only.

DETAILED DESCRIPTION OF EXEMPLARY EMBODIMENTS

Figure 1:
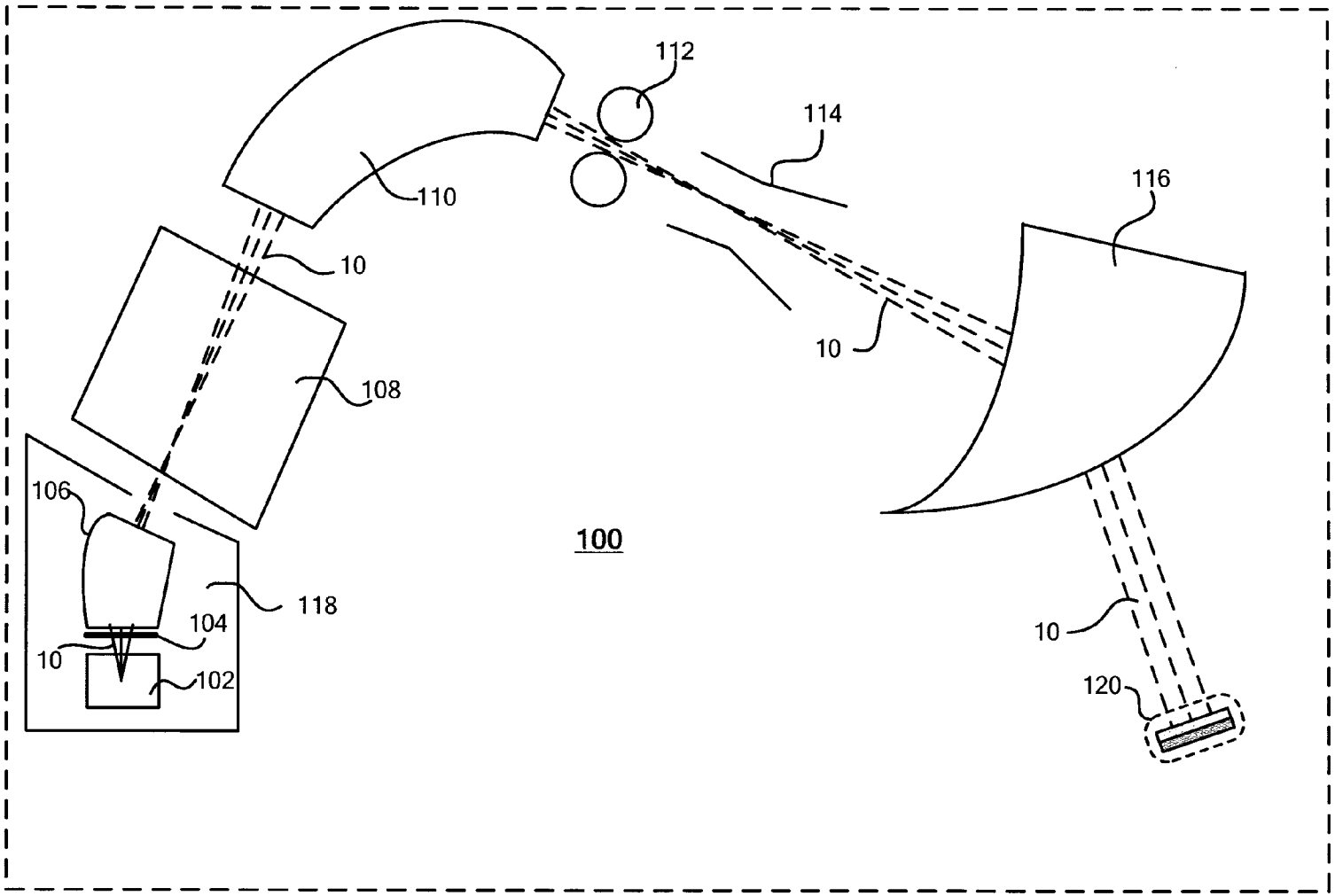
Fig. 1 (Prior Art)
FIG. 1 depicts a conventional ion implanter system.
Figure 2:
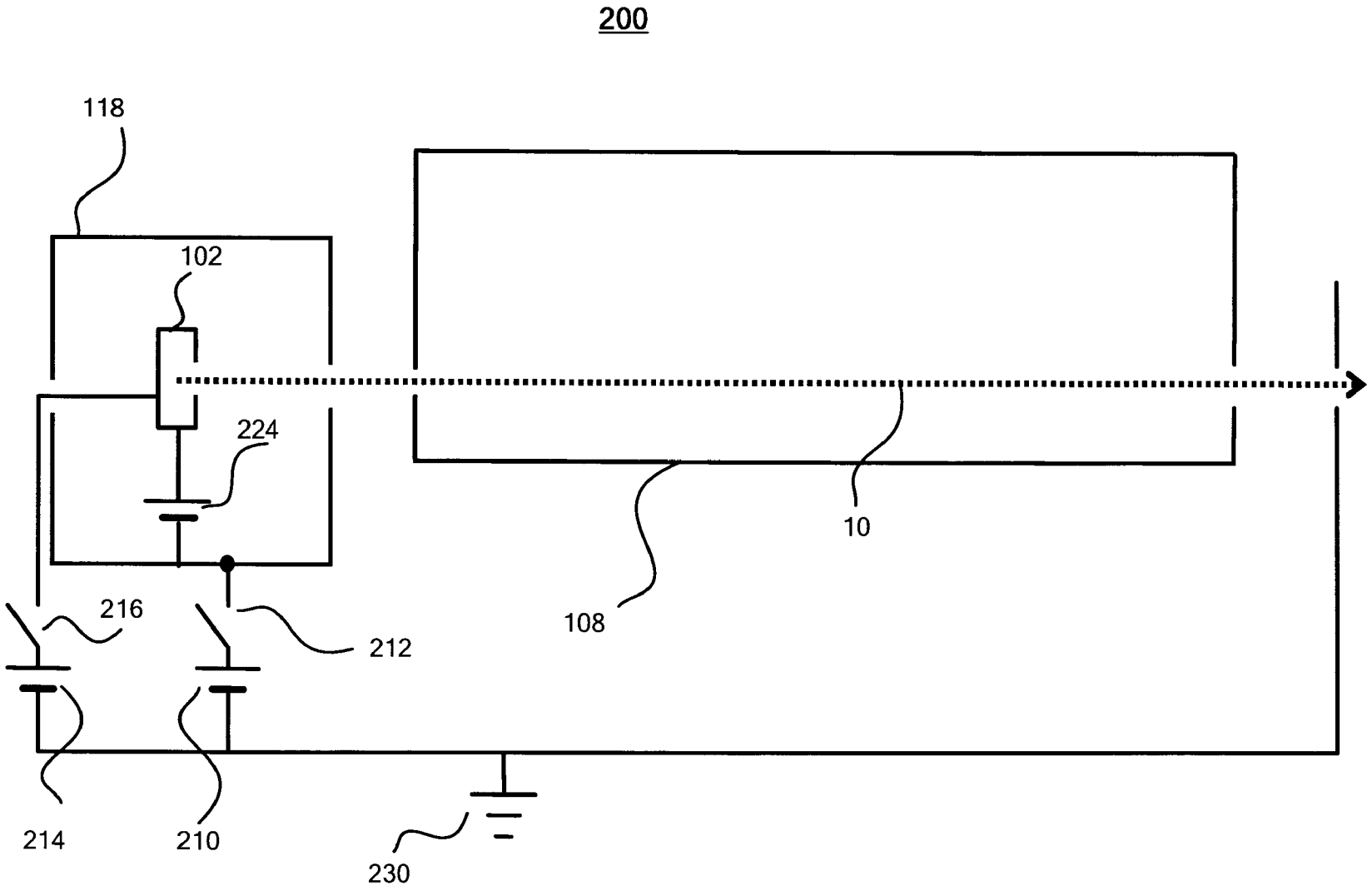
FIG. 2 depicts a schematic diagram of a charged particle acceleration/deceleration system in accordance with an embodiment of the present disclosure.

FIG. 2 depicts a schematic diagram of a charged particle acceleration/deceleration system 200 of an ion implanter in accordance with an embodiment of the present disclosure. It should be appreciated by one skilled in the art that only the ion beam 10, ion source 102, the terminal 118, and acceleration/deceleration column 108 are incorporated into FIG. 2. As a result, those elements in FIG. 2 should be understood in relation to corresponding elements in FIG. 1.

Referring to FIG. 2, in the charged particle acceleration/deceleration system 200, the ion beam 10 may be extracted from the ion source 102. The ion source 102 may be powered by an extraction power supply 224. The extraction power supply 224 may provide a positive voltage for the ion source 102 relative to the terminal 118. The ion source 102 may be separated from a ground 230 by a deceleration switch 216 and a deceleration power supply 214. The ion source 102 may also be separated from the ground 230 via the extraction power supply 224, an acceleration switch 212 and an acceleration power supply 210. The terminal 118 may be separated from the ground 230 by the acceleration switch 212 and the acceleration power supply 210.

The extracted ion beam 10 may then pass through an aperture on the terminal 118 and enter the acceleration or deceleration column 108 shown in FIG. 2. The ion beam 10 may be accelerated or decelerated to a specific energy level and then leave the acceleration or deceleration column 108.

The charged particle acceleration/deceleration system 200 may be designed to achieve a wide range of energy levels for the ion beam 10 (e.g., 1 kV to about 750 kV for single charged particles). For example, in one exemplary operation mode, the charged particle acceleration/deceleration system 200 may operate to achieve medium to high energy levels (e.g., 80 kV to 625 kV). In this operation mode, the deceleration switch 216 may be left open and the acceleration switch 212 may be closed. The ion beam 10 may be extracted by a positive extraction voltage provided by the extraction power supply 224. The acceleration power supply 210 may provide a positive voltage to the terminal 118 relative to the ground 230. Thus, after gaining initial extraction energy, the ion beam 10 may be further accelerated by the acceleration or deceleration column 108. This exemplary mode of operation may be referred to as an acceleration mode in the present disclosure.

In the acceleration mode of operation, the acceleration power supply 210 may provide a high positive voltage such as, but not limited to, a high positive voltage in the order of 670 kV. Therefore, the deceleration switch 216 may be designed to sustain a voltage gap of more than 750 kV (e.g., 80 kV of the extraction voltage and 670 kV of the acceleration voltage) between the ion source 102 and the ground 230 in the acceleration mode of operation. A number of exemplary embodiments of electrical switches that may be used as the deceleration switch 216 are shown in FIGS. 3A-8 and described below.

Figure 3A:
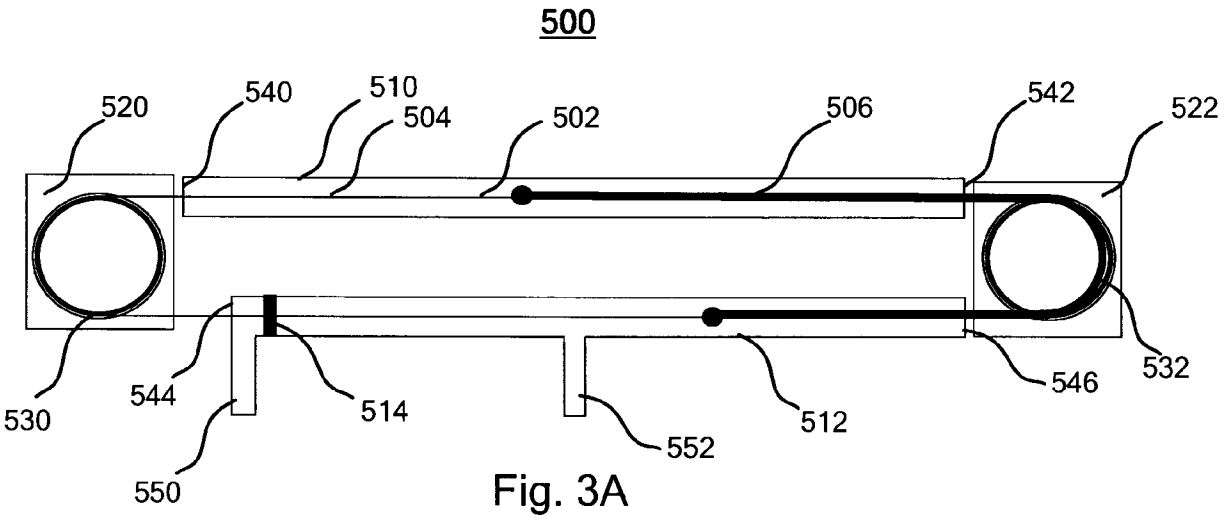
FIG. 3A depicts a schematic diagram of an exemplary electrical switch for making high voltage connection in accordance with an embodiment of the present disclosure.
Figure 3B:
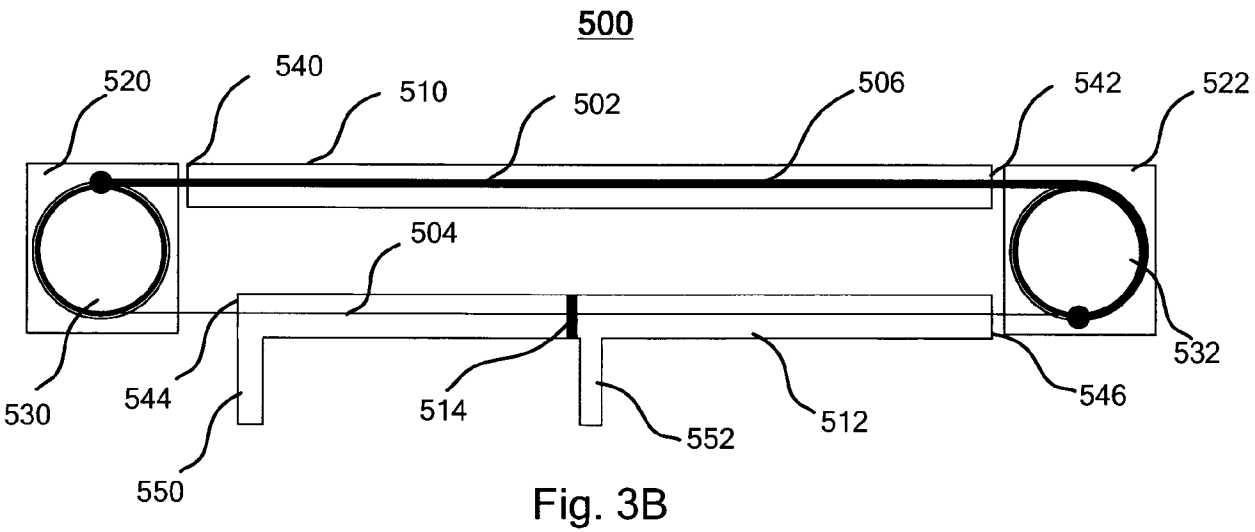
FIG. 3B depicts a schematic diagram of an exemplary electrical switch for making high voltage connection in accordance with an embodiment of the present disclosure.

FIGS. 3A and 3B depict a schematic diagram of an electrical switch 500 in accordance with an embodiment of the present disclosure.

As shown in FIG. 3A, the electrical switch 500 in accordance with an embodiment of the present disclosure may be realized by a component 502 forming a loop between a first electrical contact 520 and a second electrical contact 522. The component 502 may be a cable in the exemplary embodiment. The cable 502 may comprise a non-conductive section 504 and a conductive section 506. A section of the cable 502 may be inside a first housing 512. The first housing 512 may be capped at its two distal ends by caps 544 and 546. A section of cable 502 may be inside a second housing 510. The second housing 510 may be capped at its two distal ends by caps 540 and 542. The two housings 510 and 512 may be between the two electrical contacts 520, 522. To help insulate the electrical contacts 520 and 522, at least a section of the two housings 510 and 512 may be of a non-conductive material.

The electrical switch 500 may be operated by a piston 514 in the first housing 512. The piston may be attached to the cable 502. As shown in FIG. 3A, in a first position of operation, the electrical switch 500 is open. The piston 514 is located proximate the first electrical contact 520. The non-conductive section 504 of the cable 502 is at or around the first electrical contact 520. To facilitate the moving of the piston 514, the first housing 512 may comprise two openings 550 and 552. The two openings 550 and 552 are sized and shaped to connect with a source of pressured gas or pressured liquid. For example, to connect the electrical switch 500, a pressured gas may be inducted into the opening 550. The piston 514 may be pushed to the right in the first housing 512. The cable 502 may be pulled by the movement of the piston 514. Thus, the conductive section 506 of the cable 502 may be pulled in the opposite direction in the second housing 510. When the piston 514 reaches a second position as shown in FIG. 3B, the conductive section 506 of the cable 502 may be moved to extend from the second electrical contact 522 to the first electrical contact 520. Therefore, electrical connection between the two electrical contacts 520 and 522 may be established.

To facilitate the movement of the cable 502, a first pulley 530 and a second pulley 532 may be used, as shown in FIGS. 3A and 3B. The two pulleys may be made of conductive material to facilitate electrical connection between the cable 502 and the electrical contacts 520 and 522. Further, it should be understood that other exemplary embodiments in accordance with the present disclosure may not use pulleys. Alternatively, other mechanisms to facilitate the movement of the cable 502 may be used.

Two generally rectangular shaped electrical contacts 520 and 522 have been used in the electrical switch 500 as shown in FIGS. 3A and 3B. It should be understood that a variety of suitably shaped electrical contacts may be used in other exemplary embodiments in accordance with the present disclosure. Moreover, other mechanisms to facilitate the electrical connection between the cable 502 and electrical contacts 520 and 522 may be used in other exemplary embodiments in accordance with the present disclosure.

Referring to FIG. 3B, the electrical switch 500 is shown in a connected condition. As shown in FIG. 3B and described previously, the piston 514 may be pushed by the pressured gas or liquid to the second position, and the conductive section 506 of the cable 502 may extend between the two electrical contacts 520 and 522.

To disconnect the electrical switch 500, a pressurized fluid may be inducted into the opening 552. The piston 514 may be pushed to the left. Thus, the conductive section 506 of the cable 502 may be pulled in the opposite direction in the second housing 510 and retract back to a position at or about the second electrical contact 522.

In the exemplary embodiment of the electrical switch 500, the first housing 512 and second housing 510 may be generally tube shaped. The caps 540, 542, 544 and 546 may be generally round. In one exemplary embodiment of the electrical switch 500, pressurized air may be used to push the piston 514. The caps 544 and 546 may not be tightly sealed. In another exemplary embodiment, the second housing 510 may not be necessary.

Further, in the exemplary embodiment of the electrical switch 500, the two housings 510 and 512 may have undulations (e.g., waves or corrugations) on the surface to increase tracking distance. The pressurized fluid may be high dielectric gas (e.g., SF6 gas) or liquid (e.g., liquid silicone). The high dielectric gas or liquid may also fill the second housing 510. The tracking distance of non-conductive section 504 inside the two housings may be increased because of the high dielectric material (e.g., 20 kV/inch in SF6 gas). The caps 540, 542, 544 and 546 may be tightly sealed and may have openings suitable for high dielectric gas or liquid to fill in or drain out. Gas tight feedthrus may be used. A gas tight feedthru may use an o-ring seal around a conductor. The conductor may pass between the gas environment and the outside environment for connection, and the o-ring seal may stop the gas leaking out.

It is noted that other shapes may be used for the housings 510 and 512 in other exemplary embodiments in accordance with the present disclosure. Correspondingly shaped caps may also be used in other exemplary embodiments in accordance with the present disclosure.

In another exemplary embodiment in accordance with the present disclosure, the electrical switch 500 may have no housing between the two electrical contacts 520 and 522. The cable 502 may be adapted to move by rotation of either or both of the two pulleys 530 and 532. Each or either of the two pulleys 530 and 532 may be adapted to be driven by a motor. For example, the motor may be an electric stepper motor.

In yet another exemplary embodiment in accordance with the present disclosure, the electrical switch 500 may not have housings 512 and 510 but may have one housing that accommodates the whole assembly. That is, the two electrical contacts 520 and 522, the entire cable 502, the two pulleys 530 and 532 are all enclosed in the housing. In this particular embodiment, gas tight feedthrus may be used to connect the electrical contacts 520 and 522 to outside electrical contacts respectively. The cable 502 may be pulled by rotating either or both of the pulleys 530 and 532 by a motor (e.g., an electric motor). The housing may have an undulation and may be filled a high strength dielectric material as previously described.

The electrical switch 500 may be used, for example, as a deceleration switch 214 in the embodiment shown in FIG. 2. The housings 510 and 512 may have a small diameter (or slim if in other shapes) such that they may be suitable to pass through one small opening on the terminal 118 together, or two small openings on the terminal 118 respectively. The two electrical contacts 520 and 522 may be connected to the ion source 102 and the deceleration power supply 214, respectively. It is understood that the electrical switch 500 may also be used in other high voltage environments.

Figure 4A:
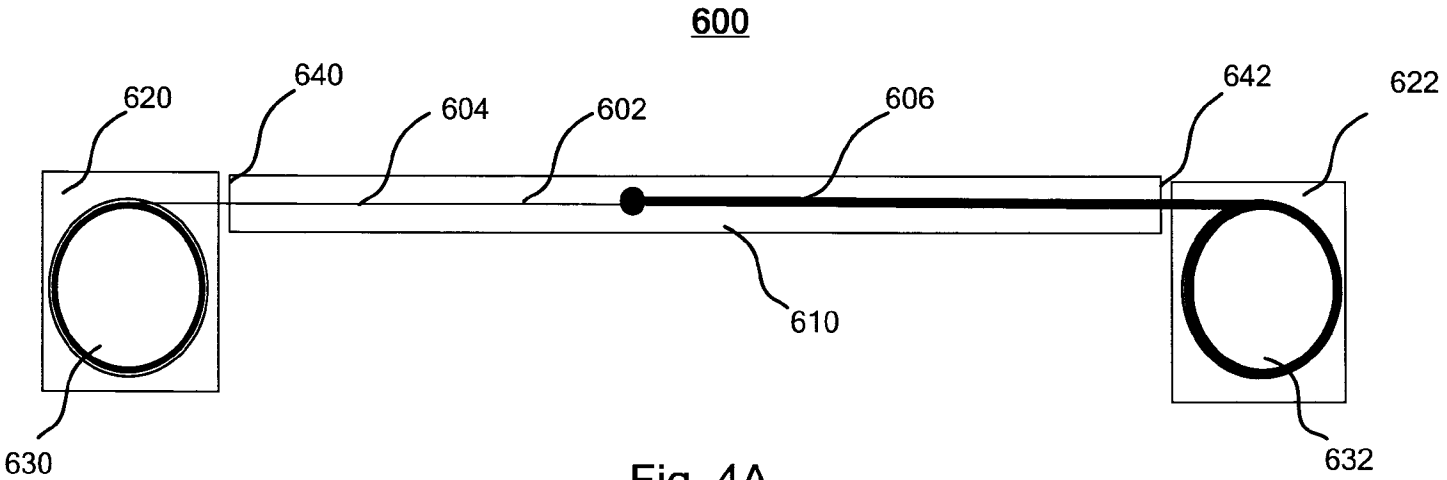
FIG. 4A depicts a schematic diagram of another exemplary electrical switch for making high voltage connection in accordance with an embodiment of the present disclosure.
Figure 4B:
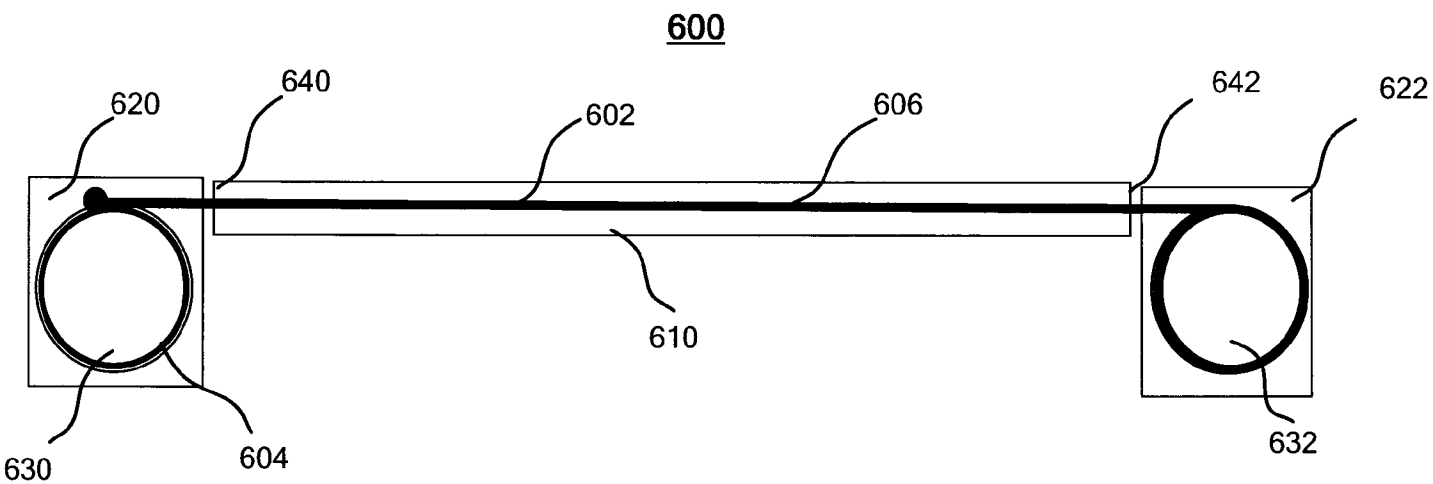
FIG. 4B depicts a schematic diagram of another exemplary electrical switch for making high voltage connection in accordance with an embodiment of the present disclosure.

FIGS. 4A and 4B depict a schematic diagram of another exemplary electrical switch 600 in accordance with an embodiment of the present disclosure.

As shown in FIG. 4A, the electrical switch 600 in accordance with an embodiment of the present disclosure may be realized by a component 602 forming a link between a first electrical contact 620 and a second electrical contact 622. The component 602 may be a cable in the exemplary embodiment shown in FIGS. 4A and 4B. The cable 602 may comprise a non-conductive section 604 and a conductive section 606. A section of cable 602 may be inside a housing 610. The housing 610 may be capped at its two distal ends by caps 640 and 642. The housing 610 may be between the two electrical contacts 620 and 622. To help insulate the electrical contacts 620 and 622, at least a section of the housings 610 may be fabricated of a non-conductive material. The two distal ends of the cable 602 are wound on two spools 630 and 632.

The electrical switch 600 may be operated by winding the two spools 630 and 632. For example, each of the two spools 630 and 632 may be driven by a motor. The motor may be an electric stepper motor in one exemplary embodiment in accordance with the present disclosure.

As shown in FIG. 4A, in a first position of operation, the electrical switch 600 is open. The non-conductive section 604 of the cable 602 is at or about the first electrical contact 620 and the conductive section is not proximate to the first electrical contact 620. The cable 602 may be pulled by winding the spool 630 counterclockwise. Thus, the conductive section 606 of the cable 602 may be pulled towards the electrical contact 620. As a result, the conductive section 606 of the cable 602 may be extended from the second electrical contact 622 to the first electrical contact 620, at a second position as shown in FIG. 4B. Therefore, an electrical connection between the two electrical contacts 620 and 622 may be established.

To facilitate electrical connection between the cable 602 and the electrical contacts 620 and 622, the spools 630 and 632 may be made of a conductive material. In the exemplary embodiment of electrical switch 600 as shown in FIGS. 4A and 4B, two generally rectangular shaped electrical contacts 620 and 622 may be used. It should be understood that a variety of suitably shaped electrical contacts may be used in other exemplary embodiments in accordance with the present disclosure. Further, it should be understood that other exemplary embodiments in accordance with the present disclosure may not use conductive spools. Moreover, other mechanisms to facilitate the electrical connection between the cable 602 and electrical contacts 620 and 622 may be used.

Referring to FIG. 4B, the electrical switch 600 is shown in a connected condition. As shown in FIG. 4B and described previously, the conductive section 606 of the cable 602 may be pulled to extend between the two electrical contacts 620 and 622 by winding the spool 630.

To disconnect the electrical switch 600, the spool 632 may wind the cable 602 clockwise. Thus, the conductive section 606 of the cable 602 may be retracted away from the first electrical contact 620. As a result, at least a portion of the non-conductive section 604 of the cable 602 may be pulled into the housing 610.

In the exemplary embodiment of the electrical switch 600, the housing 610 may be generally tube shaped. The housing 610 may have undulations (e.g., waves or corrugations). The caps 640 and 642 may be generally round and tightly sealed. Further, the housing 610 may be filled with high dielectric gas (e.g., SF6) or liquid (e.g., liquid silicone). The caps 640 and 642 may have openings suitable for high dielectric gas or liquid to fill in or drain out respectively. Gas tight feedthrus may be used.

It is noted other shapes may be used for the housing 610 in other exemplary embodiments in accordance with the present disclosure. Correspondingly shaped caps may also be used in other exemplary embodiments in accordance with the present disclosure In another exemplary embodiment in accordance with the present disclosure, the electrical switch 600 may have no housing between the two electrical contacts 620 and 622. Design rules for tracking distance in air may be applied to the non-conductive section 604 when the non-conductive section 604 may be between the two electrical contacts 620 and 622.

In yet another exemplary embodiment of the electrical switch 600 in accordance with the present disclosure, the housing 610 may enclose the whole assembly of the electrical switch 600. That is, the two electrical contacts 620 and 622, the entire cable 602, the two spools 630 and 632 are all enclosed in the housing. In this particular embodiment, gas tight feedthrus may be used to connect the electrical contacts 620 and 622 to outside electrical contacts respectively. The housing may have an undulation and may be filled a high strength dielectric material as previously described.

In still another exemplary embodiment of the electrical switch 600 in accordance with the present disclosure, the conductive section 606 of the cable 602 may be a spring (e.g., a coil spring). The non-conductive section 604 may be wound on the first spool 630 to pull the spring to connect to the electrical contact 620 and may be unwound to let the spring retract to disconnect. The second spool 632 may not be necessary for this exemplary embodiment.

The electrical switch 600 may be used, for example, as a deceleration switch 214 in the embodiment shown in FIG. 2. The housing 610 may have a small diameter (or slim if in other shapes) such that the housing 610 may be suitable to pass through a small opening on the terminal 118. The two electrical contacts 620 and 622 may be connected to the ion source 102 and the deceleration power supply 214, respectively. It is understood that the electrical switch 600 may also be used in other high voltage environments.

Figure 5:
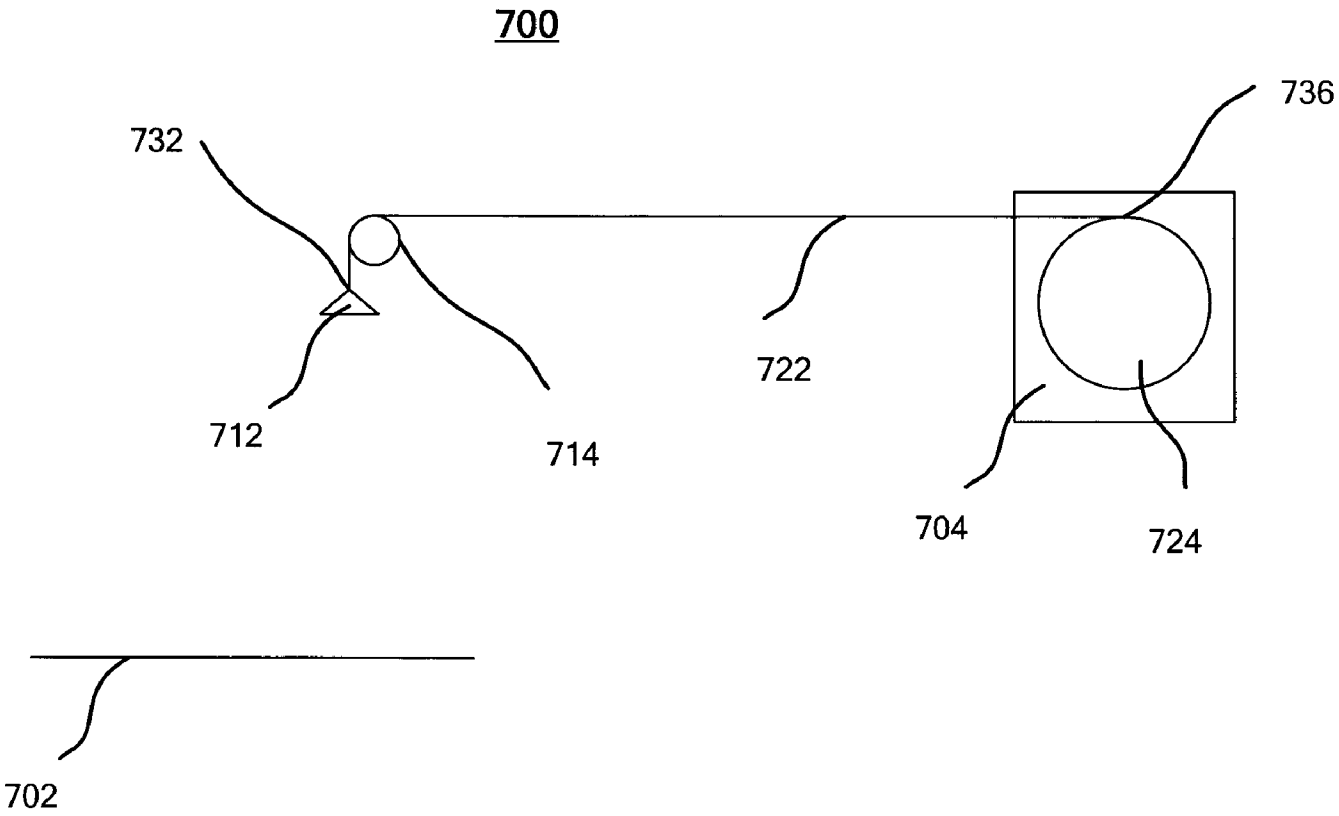
FIG. 5 depicts a schematic diagram of yet another exemplary electrical switch for making high voltage connection in accordance with an embodiment of the present disclosure.

FIG. 5 depicts a schematic diagram of yet another exemplary electrical switch 700 for making high voltage connection in accordance with an embodiment of the present disclosure.

As shown in FIG. 5, the electrical switch 700 in accordance with an exemplary embodiment of the present disclosure may be realized by a retractable conductor 712. The retractable conductor 712 may be hung around a pulley 714 by a first distal end 732 of a cable 722. The retractable conductor 712 may be lowered to make contact with a generally flat horizontal electrical contact 702. The electrical contact 702 may be referred to as a first electrical contact. The cable 722 may be conductive and connects the retractable conductor 712 to a second electrical contact 704. The cable 722 has a second distal end 736 wound around a spool 724. The spool 724 may be driven by an electric motor. The spool 724 may wind the cable 722 to control position of the retractable conductor 712. In one exemplary embodiment, the spool 724 may be made of a non-conductive material.

In a first mode of operation, the electrical switch 700 may be open, as shown in FIG. 5. The retractable conductor 712 may be retrieved to a position away from the first electrical contact 702.

In a second mode of operation, the electrical switch 700 may be closed. That is, the retractable conductor 712 may be lowered to contact the first electrical contact 702. Therefore, an electrical connection may be established between the electrical contacts 702 and 704 in the second mode of operation.

In one exemplary embodiment of the electrical switch 700, the retractable conductor 712 may have sufficient weight to lower itself to contact the first electrical contact 702 in the second mode of operation.

In another exemplary embodiment of the electrical switch 700, the position of the retractable conductor 712 may be controlled exclusively by winding the spool 724.

In yet another exemplary embodiment of the electrical switch 700, the spool 724 may be made of a conductive material to facilitate the electrical connection between the conductive cable 722 and the second electrical contact 704.

Figure 6A:
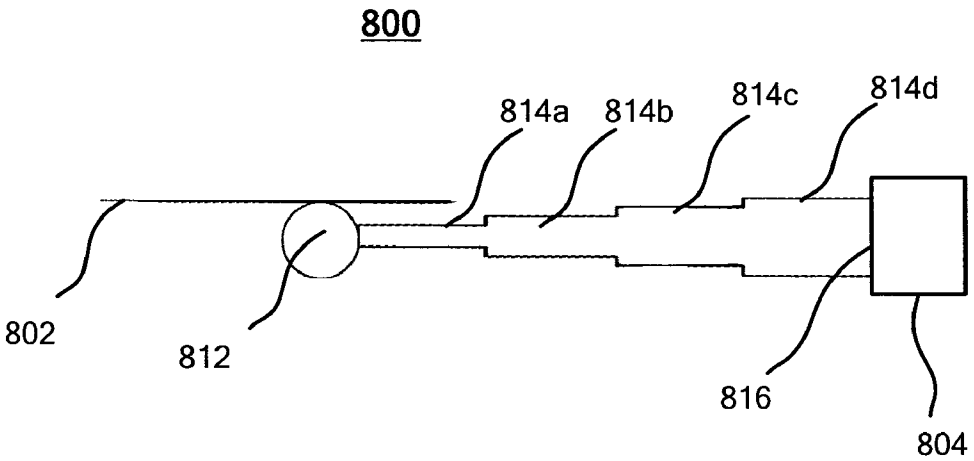
FIG. 6A depicts a schematic diagram of still another exemplary electrical switch for making high voltage connection in accordance with an embodiment of the present disclosure.
Figure 6B:
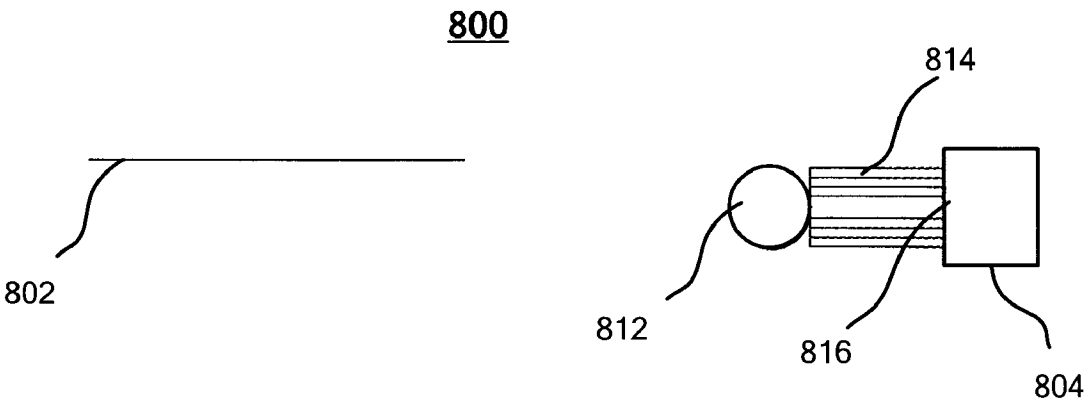
FIG. 6B depicts a schematic diagram of still another exemplary electrical switch for making high voltage connection in accordance with an embodiment of the present disclosure.

FIGS. 6A and 6B depict a schematic diagram of still another exemplary electrical switch 800 for making high voltage connection in accordance with an exemplary embodiment of the present disclosure.

As shown in FIGS. 6A and 6B, the electrical switch 800 in accordance with an exemplary embodiment in accordance with the present disclosure may be realized by a retractable conductor 812. The retractable conductor 812 may be attached to a telescoping rod 814.

In a first mode of operation, the telescoping rod 814 may extend the telescoping sections 814*a*, 814*b*, 814*c* and 814*d* to a certain position to allow the retractable conductor 812 to contact a first electrical contact 802, as shown in FIG. 6A. The first electrical contact 802 may have a generally flat surface. The retractable conductor 812 may have a curved, flexibly attached wiping contact surface. The telescoping rod 814 may be connected to a second electrical contact 804 at a distal end 816 of the telescoping conductor 814. In the first mode of operation, the electrical switch 800 may establish an electrical connection between the electrical contacts 802 and 804.

In a second mode of operation, the telescoping rod 814 may be fully retracted. The retractable conductor 812 may be at a fully retracted position. No electrical connection may be established between the electrical contacts 802 and 804 in the second mode of operation.

In exemplary embodiments of the electrical switch 800 in accordance with the present disclosure, the electrical contact 802 or the retractable conductor 812 may be shaped to comprise a suitable socket and a spring element. Thus, an electrical connection may be maintained in the first mode of operation and may not depend on a final position of the retractable conductor 812.

Figure 7A:
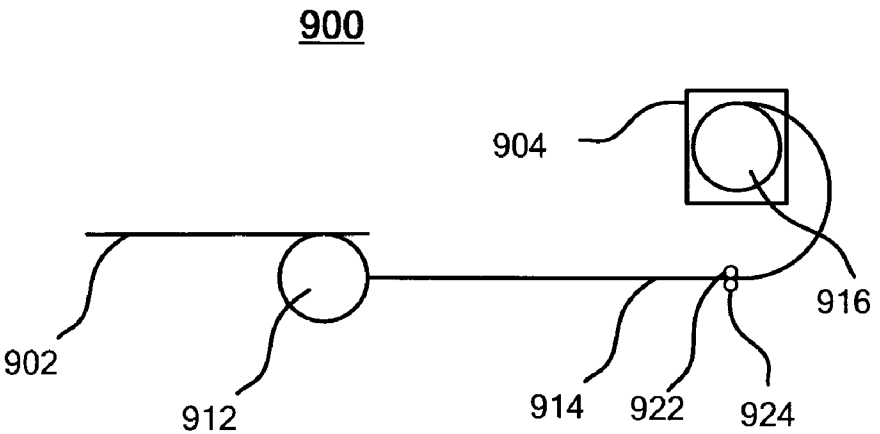
FIG. 7A depicts a schematic diagram of another exemplary electrical switch for making high voltage connection in accordance with an embodiment of the present disclosure.
Figure 7B:
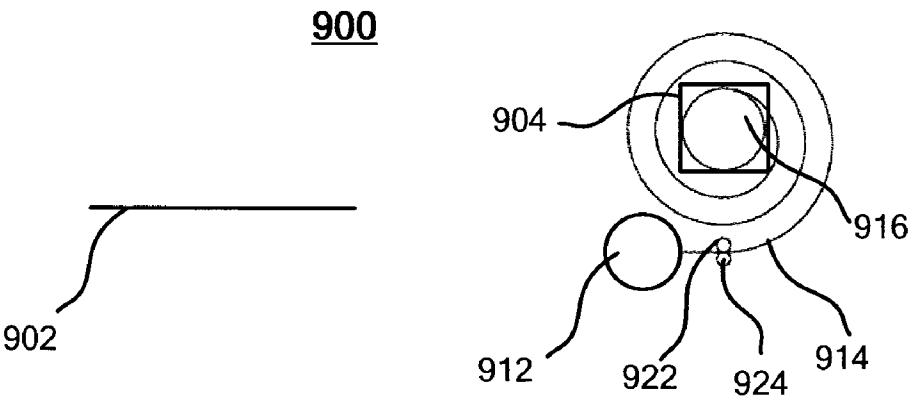
FIG. 7B depicts a schematic diagram of another exemplary electrical switch for making high voltage connection in accordance with an embodiment of the present disclosure.

FIGS. 7A and 7B depict a schematic diagram of still another exemplary electrical switch 900 for making high voltage connection in accordance with an exemplary embodiment of the present disclosure.

As shown in FIGS. 7A and 7B, the electrical switch 900 in accordance with an exemplary embodiment of the present disclosure may be realized by a retractable conductor 912. The retractable conductor 912 may be attached to a spiral conductor 914.

In a first mode of operation, the spiral conductor 914 may extend to allow the retractable conductor 912 to contact a first electrical contact 902, as shown in FIG. 7A. The first electrical contact 902 may have a generally flat surface. The retractable conductor 912 may have a curved, flexibly attached wiping contact surface. The spiral conductor 914 may be oriented by a pair of rollers 922 and 924. The spiral conductor 914 may be connected to a second electrical contact 904 at a spool 916. An electrical connection between the electrical contacts 902 and 904 may be established by the electrical switch 900 in the first mode of operation.

In exemplary embodiments of the electrical switch 900 in accordance with the present disclosure, the electrical contact 902 or the retractable conductor 912 may be shaped to comprise a suitable socket and a spring element. Thus, an electrical connection may be maintained in the first mode of operation and may not depend on a final position of the retractable conductor 912.

In a second mode of operation, the spiral conductor 914 may be fully retracted. The retractable conductor 912 may be at a fully retracted position. No electrical connection between the electrical contacts 902 and 904 may be established by the electrical switch 900 in the second mode of operation.

Figure 8:
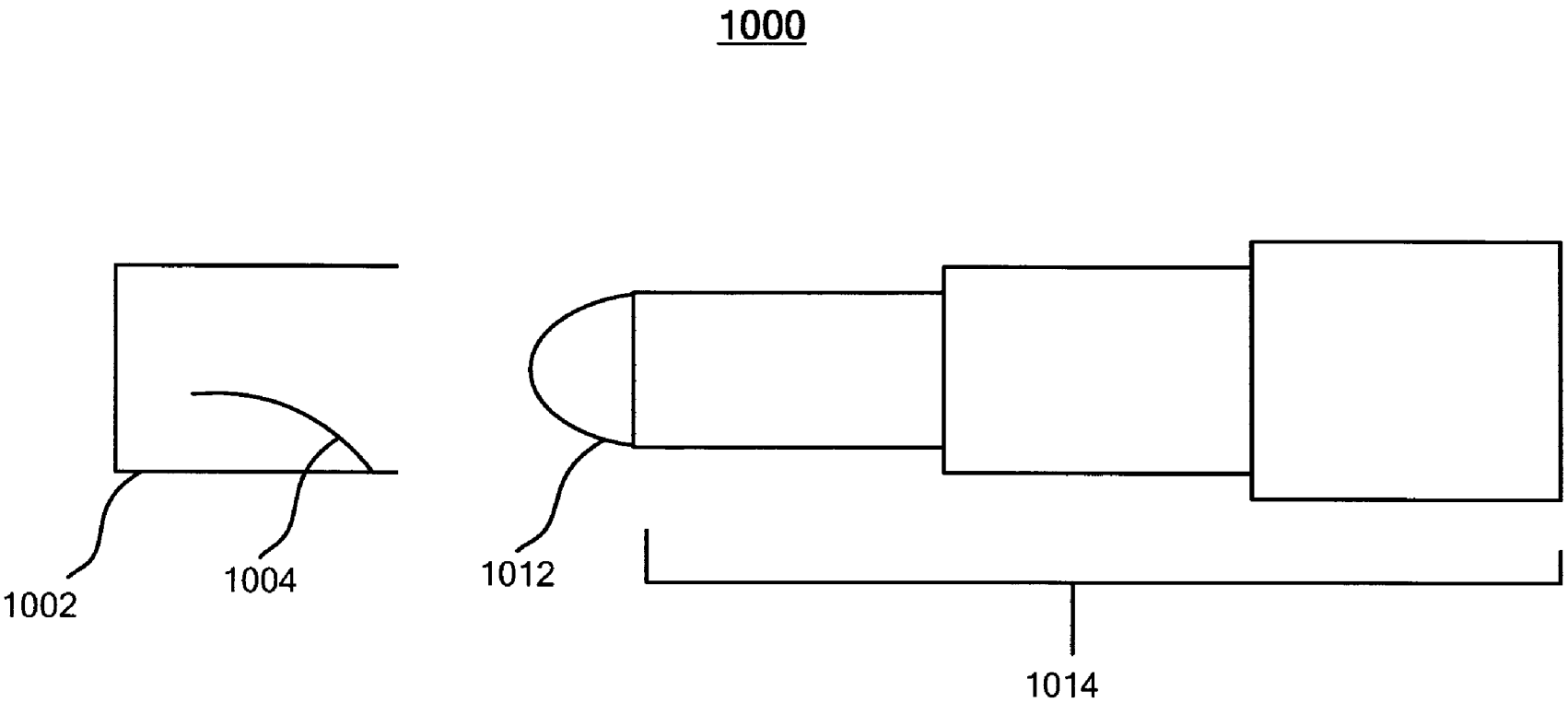
FIG. 8 depicts a schematic diagram of another exemplary electrical switch for making high voltage connection in accordance with an embodiment of the present disclosure.

FIG. 8 depicts a schematic diagram of another exemplary electrical switch 1000 for making high voltage connection in accordance with an exemplary embodiment of the present disclosure.

As shown in FIG. 8, a socket 1002 may have a wiping electrical contact 1004. A retractable conductor 1012 attached to a telescoping rack 1014 may be extended to plug into the socket 1002. The retractable conductor 1012 may have a smooth surface to facilitate high voltage. The telescoping rack 1014 may extend and retract to place the retractable conductor 1012 at desired positions. The electrical contact 1004 may be a spring in an exemplary embodiment.

It is noted that other embodiments of the socket may be used in the electrical switch 1000. For example, in one embodiment in accordance with the present disclosure, a coil spring may be used. The retractable conductor 1012 may press the coil spring to make electrical contact.

The present disclosure is not to be limited in scope by the specific embodiments described herein. Indeed, other various embodiments of and modifications to the present disclosure, in addition to those described herein, will be apparent to those of ordinary skill in the art from the foregoing description and accompanying drawings. Thus, such other embodiments and modifications are intended to fall within the scope of the present disclosure. Further, although the present disclosure has been described herein in the context of a particular implementation in a particular environment for a particular purpose, those of ordinary skill in the art will recognize that its usefulness is not limited thereto and that the present disclosure may be beneficially implemented in any number of environments for any number of purposes. Accordingly, the claims set forth below should be construed in view of the full breadth and spirit of the present disclosure as described herein.

The invention claimed is:

1. An electrical switch comprising:

a component extending from a first electrical contact to a second electrical contact, wherein the component comprises a non-conductive section and a conductive section, and in a first mode of operation, at least a portion of the non-conductive section is positioned between the two electrical contacts to insulate the two electrical contacts, and in a second mode of operation, the conductive section is positioned between the two electrical contacts to connect the two electrical contacts wherein the component is a cable forming a loop around a first pulley positioned proximate the first electrical contact and a second pulley positioned proximate the second electrical contact.

2. The electrical switch of claim 1, wherein at least one pulley is driven by a motor.

3. The electrical switch of claim 1, further comprising:

a first housing constructed substantially of a non-conductive material between the two electrical contacts, wherein at least a section of the component is in the first housing; and a shuttle attached to the component inside the first housing, wherein the shuttle is selectively displaceable within the first housing between a first position in the first mode of operation and to a second position in the second mode of operation.

4. The electrical switch of claim 3, further comprising two openings in the first housing sized and shaped to connect with a source of a pressurized fluid, wherein the shuttle is a piston, and the piston is displaced between the first and second positions by the pressurized fluid.

5. The electrical switch of claim 4, wherein the pressurized fluid is pressurized air.

6. The electrical switch of claim 4, further comprising a second housing constructed substantially of a non-conductive material between the two electrical contacts, wherein at least a section of the cable is in the second housing.

7. The electrical switch of claim 6, wherein the cable engages each distal end of the first and second housings in a fluid tight seal respectively, and the piston is displaced between the first and second position by pressurized high dielectric strength fluid selected from a group comprising: SF6 gas, and liquid silicone.

8. The electrical switch of claim 6, wherein each of the first or second housings has undulations on a surface respectively.

* * * * *